US006263622B1

(12) United States Patent
Griffin et al.

(10) Patent No.: US 6,263,622 B1
(45) Date of Patent: Jul. 24, 2001

(54) GROUND ANCHOR WITH FLOATING STABILIZER

(75) Inventors: Craig Griffin, 96 McKall Bay, Winnipeg, Manitoba (CA), R3X 1T8; Robert Donald McLeod, Winnipeg (CA)

(73) Assignee: Craig Griffin, Winnipeg (CA)

( * ) Notice: Subject to any disclaimer, the term of this patent is extended or adjusted under 35 U.S.C. 154(b) by 0 days.

(21) Appl. No.: 09/290,881

(22) Filed: Apr. 14, 1999

Related U.S. Application Data

(60) Provisional application No. 60/083,628, filed on Apr. 30, 1998.

(51) Int. Cl.[7] ..... E02D 5/80
(52) U.S. Cl. ..... 52/153; 52/156; 52/157
(58) Field of Search ..... 52/153, 155, 156, 52/157, 741.11, 745.21, 749.1

(56) References Cited

U.S. PATENT DOCUMENTS

| | | | | |
|---|---|---|---|---|
| 314,870 | * | 3/1885 | Nendel et al. | 52/157 X |
| 819,637 | * | 5/1906 | Diescher | 52/153 X |
| 3,011,598 | * | 12/1961 | Galloway et al. | 52/153 |
| 3,961,671 | * | 6/1976 | Adams et al. | 52/741.11 X |
| 4,162,789 | * | 7/1979 | Hollaway | 52/157 X |
| 5,148,641 | * | 9/1992 | Rushing et al. | 52/155 X |
| 5,457,918 | * | 10/1995 | Plourde | 52/157 X |
| 5,662,304 | * | 9/1997 | McDaniel | 52/157 X |

FOREIGN PATENT DOCUMENTS

| | | |
|---|---|---|
| 1235280 | 4/1988 | (CA) . |
| 1297259 | 3/1992 | (CA) . |
| 2155504 | 2/1997 | (CA) . |

* cited by examiner

*Primary Examiner*—Carl D. Friedman
*Assistant Examiner*—Kevin D. Wilkens
(74) *Attorney, Agent, or Firm*—Adrian D. Battison; Michael R. Williams

(57) ABSTRACT

A ground anchor with a floating stabilizer consists of an elongate shaft, a screw flight coupled to the shaft at the lower end and an extension point mounted to the shaft at its lowermost point. A drive handle is provided for rotating the shaft about the axis and threading the flight into the ground. A winged stabilizer member fits over the shaft such that it floats freely of the shaft after installation to accommodate ground heave. An L-shaped mounting member is carried on a threaded rod screwed into a female thread at the top of the shaft for engaging a structure and supporting the structure relative to the ground.

3 Claims, 2 Drawing Sheets

GROUND ANCHOR WITH FLOATING STABILIZER

This application claims priority under 35 U.S.C. 119, Provisional Application, Serial No.: 60/083,628, filed Apr. 30, 1998.

BACKGROUND OF THE INVENTION

1. Field of the Invention

This invention relates to a manually operable ground anchor system, particularly of a type which can be screwed into the ground to provide support for an above ground structure, such as a deck or garage. Ground anchors of this type generally consist of an elongate shaft, sometimes comprising a tube, a screw flight coupled to the shaft at the lower end, means for engaging a handle for rotating the shaft about the axis and threading the flight into the ground, a winged stabilizer member fitted over the shaft and connected via a threaded rod to a mounting assembly for engaging a structure relative to the ground.

An example of a ground anchor of this type is shown in Canadian Patent 1,297,259.

2. Description of Related Art

Ground anchors of this type are known to employ a stabilizer assembly, generally comprising a sleeve for fitting over top of the shaft, an end plate and a plurality of wings welded to the outside of the sleeve. It is further known to include a mounting assembly comprising an elongate threaded rod carrying a nut welded to it for rotating said rod into the shaft and engaging the end plate of the stabilizer assembly.

In a known arrangement of such a stabilizer assembly, the stabilizer, although separate from the shaft, is locked in place by the nut welded to the threaded rod and engaging the end plate. In this manner the stabilizer assembly is held firm against vertical movement relative to the shaft. However, such a rigidly fixed stabilizer device as this, while preventing vertical movement of the shaft under normal conditions, is susceptible to upward ground forces prevalent in many areas due to either swelling of clay or soil with the presence of moisture, or heaving from frost. Such forces, acting on a fixed stabilizer, may apply a shear stress pulling the entire anchor upward.

It is further known that said mounting assembly further includes a mounting bracket assembly comprises of a great number of plates, sleeves, nuts and bolts such as to prevent the upward movement of the mounting bracket. These parts are superfluous, however, to the necessary functions to the stabilizer or mounting assembly.

OBJECT AND SUMMARY OF THE INVENTION

The first object of the invention, therefore, is to provide a floating stabilizer mechanism such that it accommodates by floating the shear stresses of frost heaves or swelling soil acting on the stabilizer, thereby preventing the anchor from being pulled upward from the ground by the forces acting on the stabilizer itself.

Another object of the invention to provide a simplified arrangement of the ground anchor defined above, such that will enable reductions in costs of manufacture and ease of use.

According to these aspects of the invention, there is provided a ground anchor comprising an elongate shaft, a screw flight coupled to the shaft at the lower end, an extension point mounted to the shaft at its lowermost point, means for engaging a handle for rotating the shaft about the axis and threading the flight into the ground, a winged stabilizer member fitted over the shaft such that it floats freely on the shaft and a mounting member connected via a threaded rod to the shaft for supporting a structure relative to the ground.

One embodiment of the invention will be described with reference to the Figures.

DETAILED DESCRIPTION

Figure 1:
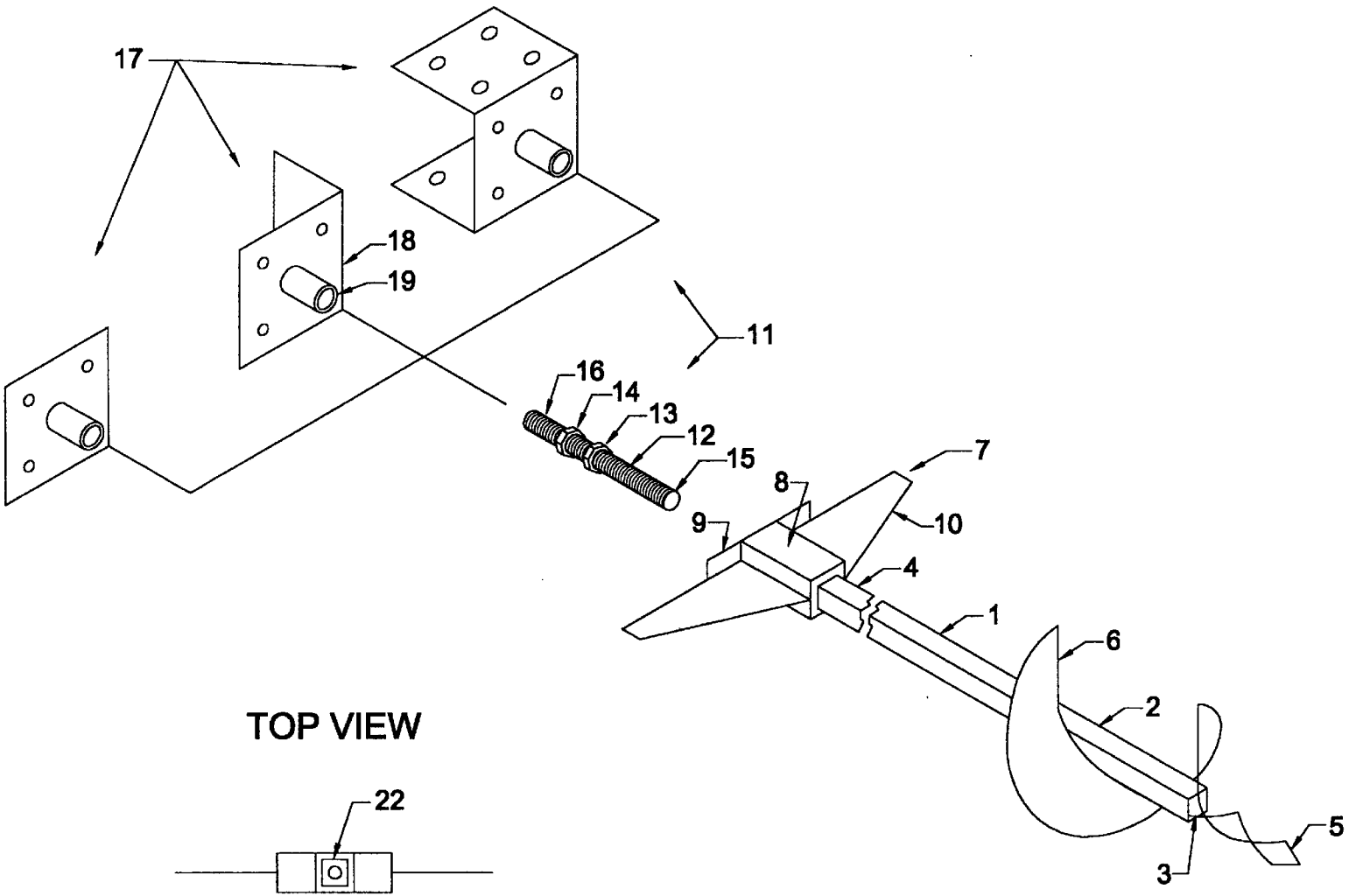
FIG. 1 is an isometic view of an assembled ground anchor according to the present invention.

The ground anchor shown in the drawings comprises an elongate shaft 1 with a lower end 2 on which is mounted a screw flight 6. The shaft has a longitudinal axis around which the flight is threaded so that it can be driven into the ground when rotated. The shaft has a lowermost point 3 on which is mounted an extension point 5, said extension point facilitating accurate positioning of the flight and ease of engagement with the ground when rotated about the its axis. The elongate shaft, according to FIG. 1, has an outside diameter of 1 inches but may be 1¼ inches, and generally has a total length of eight feet. In a preferred arrangement, the bottom seven feet of said shaft comprises a tube and the remaining foot length on the shaft's upper end, generally indicated at 4, is solid containing a threaded bore. The screw flight typically has one or more turns with a diameter of approximately eight inches. The extension point has an axial length of six inches sufficient to provide greater ease in positioning and rotating the flight into the ground.

At the upper end of the elongate shaft 4 which is non-circular such as square, is fitted a stabilizer mechanism generally indicated at 7, comprising a sleeve 8, an end plate 9, with which the stabilizer can be driven by hammer into the ground, and a plurality of wings 10 welded to the outside of the sleeve and extending generally radially outward therefrom. In the example shown in FIG. 1 there are two such wings, arranged at 180° spacing around the sleeve but there could be more if situations required. The sleeve is of four inches of length and has an inside diameter substantially equal to the outside diameter of the shaft over which it fits so as to be a sliding fit. The end plate 9 has dimensions of two inches and width and six inches in length. The ground anchor when assembled further includes a mounting assembly generally indicated at 11 comprising an elongate threaded rod 12 carrying a lower locking nut 13 and an upper nut 14, welded to the rod six inches from the lowermost end of the rod 15 and 2¼ inches from the upper end of the rod 22. The total length of the threaded rod 12 is thus 8¼ inches. The nut 14 can be rotated to drive the threaded rod into a female screw thread 16 at the upper part of the shaft 4 until the lock nut 13 reaches the shaft.

The mounting assembly also includes a mounting bracket, generally indicated at 17 comprised of a horizontal base plate 18 and a pipe of two inch length 19 for sliding over the threaded rod 12. As shown in FIG. 1 the mounting bracket may be single, L-shaped or double L-shaped.

Figure 2:
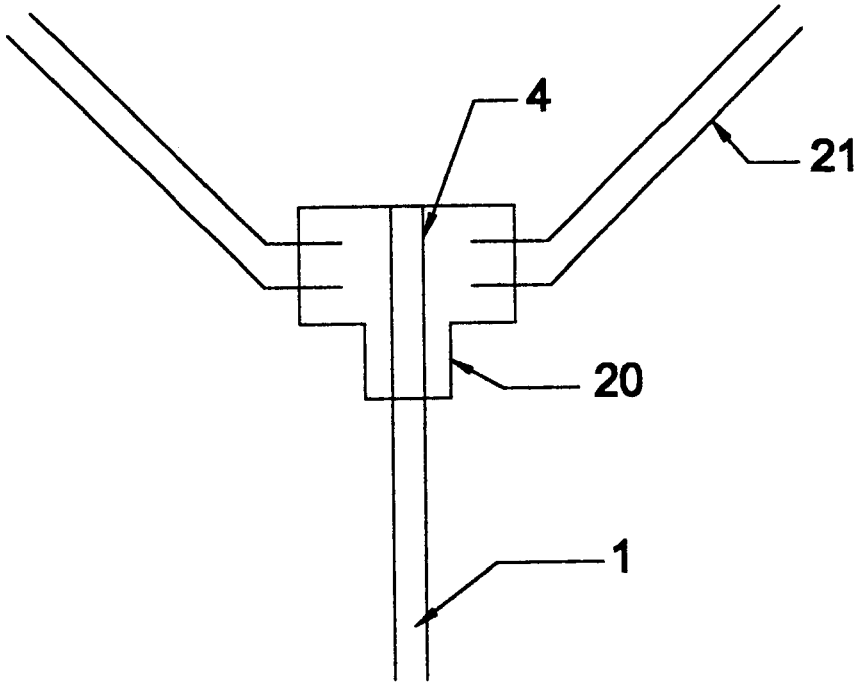
FIG. 2 is a cross sectional view of the handle mechanism during installation of the ground anchor.
Figure 3:
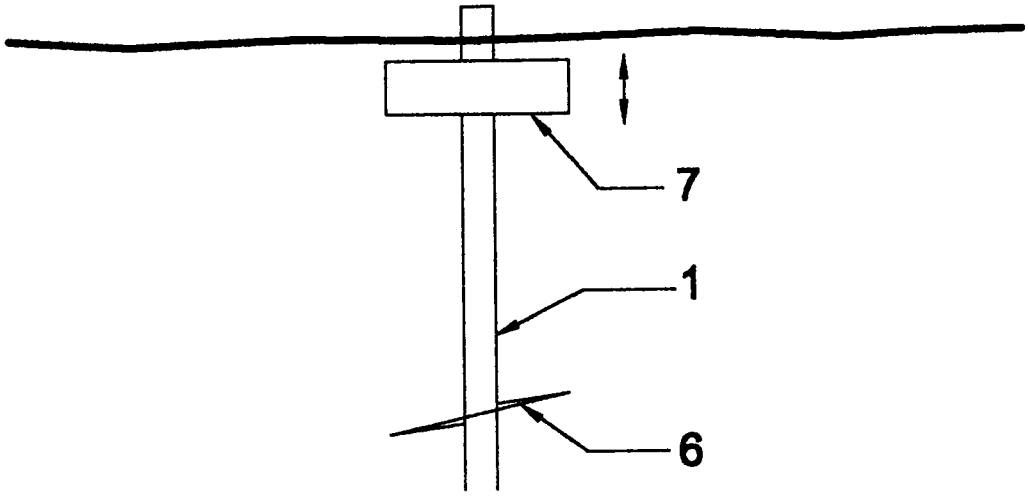
FIG. 3 is a cross sectional view of the assembled anchor in the ground indicating one aspect of the floating stabilizer in operation.

In mounting the anchor into the ground, the stabilizer sleeve 8 is removed and a wrench socket 20 is engaged with the shaft by fitting over the upper part of the shaft 4. As is shown in FIG. 2, the socket fits two hockey stick-shaped wrench handles 21 of sufficient length to allow the user to apply manual force in the direction appropriate for driving the extension point and flight into the ground.

When the shaft is driving substantially into the ground the wrench handles and socket are removed and the floating stabilizer assembly is fitted over the upper part of the shaft. The stabilizer can the be driven manually into the ground by engaging a hammer or equivalent with the end plate 9 of the stabilizer. At this point the threaded rod 12 can be rotated into the shaft from which it is supported vertically therewith to receive the mounting assembly as described.

Since there are many modifications that can be made in the invention as described herein, as well as many different arrangements of the same within the spirit and scope of the invention, it is intended that all matter contained in the accompanying specification and figures shall be interpreted as illustrative only.

What we claim is:

1. A support anchor for supporting in the ground an above ground structure comprising:

an elongate shaft having an upper end and a lower end, a screw flight rigidly coupled to the shaft at the lower end of the shaft for rotation therewith such that the screw flight is screwed into the ground with the shaft standing upwardly in the ground;

the shaft including at least a portion thereof which is non circular and shaped such that the shaft can be grasped at the portion and rotated to drive the screw flight into the ground;

a male screw thread member at the upper end of the shaft projecting upwardly from the ground;

a mounting member for mounting on an upper end of the male screw thread member for supporting the above ground structure on the shaft;

a stabilizer member separate from the shaft including a sleeve portion shaped to closely surround the shaft for sliding movement therealong, said sleeve portion being shaped in cross section to co-operate with the non-circular portion of the shaft prevent rotational movement of the shaft relative to the sleeve portion and a plurality of wing members rigidly connected to said sleeve portion and extending substantially radially outwardly therefrom at angularly spaced locations therearound with each wing member shaped such that the wing members engage into the ground as the stabilizer member is forced into soil surrounding the shaft;

the stabilizer member, with the stabilizer member installed on the shaft in the ground and with the mounting member installed on the male screw thread member, being free to float both upwardly and downwardly along the shaft.

2. The support anchor according to claim 1 wherein the shaft has a female screw thread at its upper end into which the male screw thread member is inserted to allow adjustment of a height of an upper end of the male screw thread member relative to the shaft.

3. The support anchor according to claim 1 wherein the mounting member includes a pipe for sliding over an uppermost threaded section of the male screw thread member.

* * * * *